US008505755B2

(12) United States Patent
Greenberg

(10) Patent No.: US 8,505,755 B2
(45) Date of Patent: Aug. 13, 2013

(54) STRAW HOLDER FOR SUPPORTING A DRINKING STRAW IN A BOTTLE

(75) Inventor: Alex M. Greenberg, New York, NY (US)

(73) Assignee: Greenberg Surgical Technologies, LLC, New York, NY (US)

( * ) Notice: Subject to any disclaimer, the term of this patent is extended or adjusted under 35 U.S.C. 154(b) by 3152 days.

(21) Appl. No.: 10/684,882

(22) Filed: Oct. 14, 2003

(65) Prior Publication Data

US 2005/0077371 A1 Apr. 14, 2005

(51) Int. Cl.
*B65D 51/00* (2006.01)
*A47G 19/22* (2006.01)

(52) U.S. Cl.
USPC ..... 215/229; 215/200; 215/228; 220/200; 220/709; 220/713

(58) Field of Classification Search
USPC ..... 215/229, 386–388, 232, 200; 220/730, 220/713, 703, 229, 212, 709, 705, 699, 700, 220/200; 229/4, 404, 906.1; 40/310; 206/308.1; 239/29.3, 33, 17; 446/489, 490, 446/77, 76, 71, 248–253, 266
See application file for complete search history.

(56) References Cited

U.S. PATENT DOCUMENTS

| | | | | |
|---|---|---|---|---|
| 947,098 | A | 1/1910 | Ellis | |
| 1,735,144 | A * | 11/1929 | Tanner | 215/391 |
| 1,962,883 | A | 8/1932 | Tate et al. | |
| 2,070,495 | A | 4/1935 | Strutz et al. | |
| 2,112,477 | A | 3/1938 | Brownfield | |
| 2,378,660 | A | 5/1944 | Roux | |
| 3,438,527 | A | 4/1969 | Gamblin, Jr. | |
| 4,049,153 | A * | 9/1977 | Elsasser | 220/345.1 |
| 4,247,016 | A * | 1/1981 | Shaw | 220/708 |
| 4,765,090 | A * | 8/1988 | Kuan et al. | 43/127 |
| 4,872,577 | A * | 10/1989 | Smith | 220/739 |
| 4,909,437 | A | 3/1990 | Kang | |

(Continued)

FOREIGN PATENT DOCUMENTS

| | | | |
|---|---|---|---|
| GB | 2382069 | A * | 5/2003 |
| JP | 08-072845 | | 3/1996 |
| WO | WO99/65782 | A1 * | 12/1999 |

OTHER PUBLICATIONS

Search Report dated May 11, 2007 issued for the corresponding International Application No. PCT/US04/32903.

*Primary Examiner* — Robin Hylton
(74) *Attorney, Agent, or Firm* — Cozen O'Connor

(57) ABSTRACT

A straw holder for vertically supporting a drinking straw in the mouth of a bottle containing a beverage to be consumed and for limiting vertical movement of the straw with respect to the bottle. The straw holder includes a straw support portion dimensioned for placement across the mouth of the bottle and having an aperture defined in the straw support. The aperture receives the drinking straw so that the straw is disposed through the aperture with a leading edge of the straw positioned in the bottle in communication with the beverage. The aperture is dimensioned for adjustably maintaining a vertical position of the leading edge of the straw in the bottle once a desired vertical position is selected. The straw holder also includes a bottle retaining portion coupled to the straw support portion for maintaining the position of the straw support across the mouth of the bottle. The bottle retaining portion includes at least one turn dimensioned for engaging the neck of the bottle.

19 Claims, 2 Drawing Sheets

(56) References Cited

U.S. PATENT DOCUMENTS

| | | | | |
|---|---|---|---|---|
| 5,160,058 | A | 11/1992 | Ahn | |
| 5,671,863 | A | 9/1997 | Uliana | |
| D387,396 | S * | 12/1997 | Chao | D21/91 |
| 5,823,493 | A | 10/1998 | Eastland, Jr. et al. | |
| 5,948,424 | A * | 9/1999 | Kandathil et al. | 424/411 |
| 5,992,658 | A * | 11/1999 | Berger | 215/232 |
| 6,763,681 | B1 * | 7/2004 | Klundt | 63/1.11 |
| 7,100,787 | B2 | 9/2006 | Farnsworth et al. | |
| 2005/0029270 | A1 * | 2/2005 | Marshall | 220/705 |

* cited by examiner

STRAW HOLDER FOR SUPPORTING A DRINKING STRAW IN A BOTTLE

BACKGROUND OF THE INVENTION

1. Field of the Invention

The invention relates to a straw holder for vertically supporting and orienting a drinking straw in the mouth of a bottle.

2. Description of the Related Art

Consumers of beverages under some circumstances may prefer to drink directly from a bottle through a straw. While driving a car, for example, bottled liquid is less subject to spillage, but tipping up the bottle for a drink interrupts a driver's view of the road. Use of a straw with a bottle addresses both the spillage and safety issues, but presents a problem when a too-short straw falls into a too-long bottle. In addition, carbon dioxide bubbles from a carbonated beverage may accumulate on the straw and cause it to rise out of the bottle. It would, therefore, be desirable to support the straw vertically in the bottle so that it cannot fall in or rise out. At the same time, it would be desirable to stabilize the angular position of the straw so that it cannot rotate within the mouth of the bottle. A device addressing this problem could also be used by invalids who may not have full use of their hands.

The problem of stabilizing a straw with respect to the lip of a cup is addressed by U.S. Pat. No. 5,823,493, which discloses a straw holder cut from a sheet material such as paper. The holder includes a retaining portion having an aperture which receives a standard drinking straw therethrough, and a pair of wings having ends which are clipped together and fitted against the outside of the cup.

The problem of stabilizing the position of a straw in a bottle by means of a simple fabricated device does not appear to have been solved. U.S. Pat. No. 3,606,156 discloses a drinking straw formed with an intake portion received in a bottle, a helical portion fitted around the neck of the bottle, and an outlet to which suction is applied by a consumer. The object is to stabilize the position of a straw for use by small children, but the circuitous path of the straw requires considerable effort to draw liquid. Further, the specially formed straw is a three dimensional object which is relatively expensive to manufacture and inconvenient to store and transport in any quantity. As such it is not suitable for use as a "give-away" item with a bottled beverage.

Other prior art describes straw holders for positioning a straw with respect to the lip of a cup. See, e.g., U.S. Pat. Nos. 2,070,495 and 5,823,493. The latter discloses a straw holder which can be cut from a sheet material and relies on the straw itself to position the holder on the cup.

SUMMARY OF THE INVENTION

The object of the invention is to provide a simply and economically manufactured device for stabilizing the position of a straw received in the mouth of a bottle.

According to the invention, this object is achieved by a straw holder including a straw support portion having a central aperture dimensioned to receive a straw in an interference fit, and a bottle retaining portion having at least one turn extending around the retaining portion. Preferably there are several turns, which may have a spiral configuration in order to be fitted around the neck of a bottle in a range of sizes. In use, the straw support portion is received against the mouth of a bottle and a straw is inserted in the aperture, which may be configured with a tab or other resilient receiving means to provide a radial force on the straw. One or more of the turns is received under a flange or screw ramp near the mouth of the bottle to retain the straw holder on the bottle.

The straw holder according to the invention can be simply fabricated from a sheet material such as paper, cardboard, or plastic such as polyurethane. The sheet material is preferably die-cut to form slits which define the central aperture and the turns of the finished device. The straw holder itself is preferably two dimensional when not in use, and may therefore be stacked to provide considerable economy of space. Since the straw holder according to the invention may be manufactured even more cheaply than lids for disposable cups, it is suitable for use as a "give-away", optionally provided with a straw at the point of sale for a bottled beverage. As such, straw manufacturers might wish to provide the straw holder as a "value added" item.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
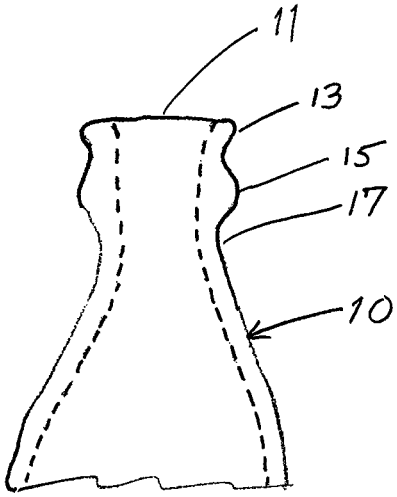
FIG. 1 is a partial elevation view of a conventional glass beverage bottle.

Referring to FIG. 1, a conventional bottle 10 has a mouth 11 surrounded by a lip or first flange 13 which is used to retain a crimped on metal cap (not shown), followed by a second flange 15 which imparts strength to the neck 17 of the bottle and also facilitates automated handling. The body 18 of the bottle extends to a bottom (not shown) which may be up to 10 inches from the mouth.

Figure 2:
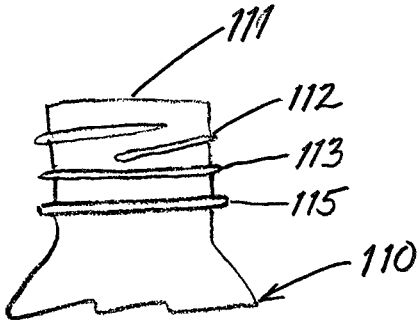
FIG. 2 is a partial elevation view of a modern plastic beverage bottle.

FIG. 2 shows a modern plastic bottle 110 having a mouth 111 surrounded by a first flange 113 spaced some distance from the mouth 111, and a plurality (typically three) of ramps 112 which serve to retain a screw-on cap (not shown). The first flange 113 is separated from a second flange 115 by a channel 114 which serves to retain a collar formed integrally with a plastic cap and connected thereto by frangible tabs. When the cap is initially screwed off, the tabs break as the collar abuts the first flange 113. Many variations of the above examples of bottles are known, including bottles with only ramps for retaining a screw-on cap. The straw holder according to the invention only requires that the bottle have some sort of radially outward extending protrusion near the mouth of the bottle in order to retain the straw holder. Even bottles which do not take caps, such as wine bottles, typically have some type of flange near the mouth of the bottle in order to facilitate automated corking and provide additional thickness for resistance to breakage.

Figure 3:
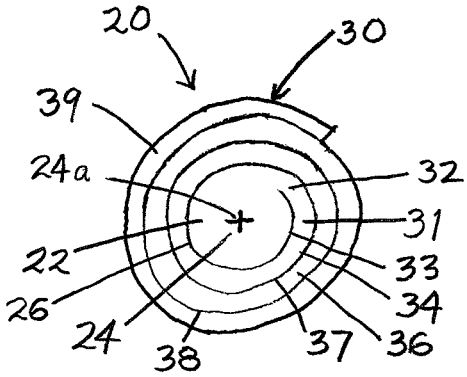
FIG. 3 is a plan view of a first embodiment of a straw holder according to the invention.

FIG. 3 is a plan view of a first embodiment of the straw holder 20, which includes a straw support portion 22 having a central aperture 24 dimensioned to receive a straw in an interference fit. In the present example the aperture 24 is formed by a pair of crossed slits which form four bendable tabs as is common in lids on cups. The aperture may also be profiled by a circular hole having one or more bendable tabs extending radially inward to exert a radial force on the straw, thereby preventing vertical movement of the straw with respect to the straw holder. Alternatively, or in addition, an adhesive material 24*a* may be present on the bendable tabs, which adhesive may be exposed by removing a masking film (not shown) or the like for further securing the straw in the aperture 24. The straw support portion 22 has an outer edge 26 of continuously increasing radius, forming the profile of a nautilus. A bottle retaining portion 30 connected to the straw support portion 22 comprises a plurality of turns connected to form a spiral. More particularly, the retaining portion 30 comprises a first turn 31 having a first end 32 connected to the straw support portion 22, and a second turn 36 connected to the first turn 22 to form a spiral having two turns. The first turn has an inner edge 33 and an outer edge 34, and the second turn has an inner edge 37 and an outer edge 38. The inner edge 33 of the first turn follows the outer edge 26 of the straw support portion 22, while the inner edge 38 of the second turn 36 follows the outer edge 34 of the first turn 31. This configuration results from the cutting of the straw holder from a sheet material with a single slit between turns, which not only economizes use of material, but spaces the turns as closely as possible in order to optimize retention of the holder 20 on a bottle. A third turn 39 is constructed similarly to the first two turns. The turns need not have edges with continuously increasing radii, but may have irregular or undulating edges for decorative effect.

Figure 4:
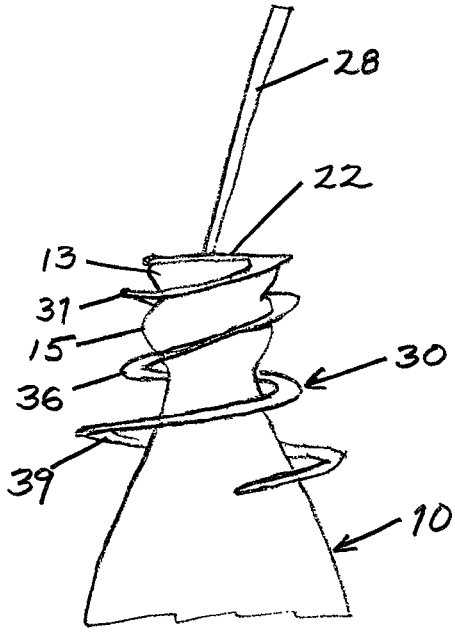
FIG. 4 is a partial elevation view of the straw holder fitted to a conventional beverage bottle while supporting a straw.

FIG. 4 shows a straw holder 20 of the type depicted in FIG. 3 fitted to a bottle 10 of the type depicted in FIG. 1. The straw support portion 22 is positioned across, and rests on, the mouth of the bottle, and a straw 28 is fitted in the aperture 24 in an interference fit, which prevents the straw from dropping into the bottle. The first turn 31 is fitted around the first flange 13, which provides a downward facing shoulder which retains the turn 31 axially. The second turn 36 is fitted around the second flange 15, which provides a downward facing shoulder which retains the second turn 36 axially. The third turn 39, shown positioned loosely around the neck of the bottle, does not serve any retaining function with a bottle of this size. However, if the straw holder 20 were fitted to a bottle with a wider mouth, the first and possibly the second turns might serve no retaining function while the third turn 39 would be retained axially by a ramp or flange formed on the bottle. Of course the bottle retaining portion 30 may be provided with any number of turns, which makes it useful with a wide range of bottle sizes. A small number of turns or a single turn, on the other hand, would be dedicated to use with a more limited range of bottle sizes.

Figure 5:
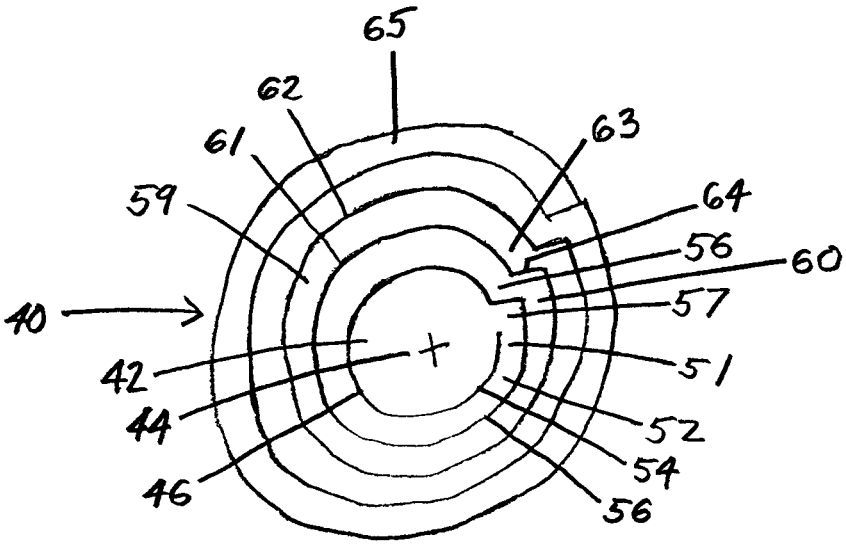
FIG. 5 is a plan view of a second embodiment of straw holder according to the invention.

FIG. 5 shows an alternative embodiment of straw holder 40 which includes a straw support portion 42 having an aperture 44 and an outer edge 46 having a substantially circular profile. The bottle retaining portion 50 includes a first turn 52, a second turn 59, a third turn 65, and a fourth turn 66. The first turn 52 has a first end 51, a second end 56, an inner edge 54, and an outer edge 55. The first end 51 is connected to the straw support portion 42 by a radial connecting portion 57, and the inner and outer edges 54, 55 each have a substantially constant radius, the inner edge 54 following the outer edge 46 of the straw support 42. The second turn 59 has a first end 60, a second end 63, an inner edge 61, and an outer edge 62. The first end 60 is connected to the second end 56 of the first turn 52 by a radial connecting portion 64, and the inner and outer edges 61, 62 each have a substantially constant radius, the inner edge 61 following the outer edge 55 of the first turn 52. The third and fourth turns 65, 66 are similarly constructed, the number of turns once again depending on the degree of universality which is desired. The substantially constant inner radii of the turns offers the advantage of a secure fit when one of the inner radii is closely matched to the radius of a surface under a flange or a set of ramps as depicted in FIG. 2. It is also possible to choose the inner radii of the turns to correspond to standard radii used with standard cap sizes. This may result in turns having non-uniform width, i.e. different distances between the inner and outer radii of the respective turns.

When in use, the present invention provides a straw holder 20 for positioning about the neck of a bottle with the straw support portion 42 disposed on the mouth of the bottle. Once so-positioned, a straw can be inserted into aperture 44 whereupon the straw can be used to consume the beverage from the bottle. In the case where the straw length is shorter than the bottle depth, the end of the straw that is disposed in the bottle is positioned above the inside bottom surface of the bottle. Once a majority of the beverage has been consumed and the remaining amount cannot be accessed by the straw (as a result of the straw length and position), the bottle can then be tilted so that the straw will have access to the remaining beverage amount.

When the straw holder according to the invention is cut from a sheet material, it may be provided with an adhesive backing and a peel-off layer which can be removed prior to use. The straw support portion may thereby be firmly adhered to the mouth of the bottle and the turns may be adhered to the neck of the bottle. In this regard it would only be necessary to provide the adhesive on the straw support and the tail end of the outer turn. Where the material of the straw holder or at least a portion of the straw holder, preferably a part adhered to the bottle, is made of a material whose color is temperature-dependent, it can provide an indication of the temperature of the bottle and its contents. In lieu of a peel-off layer, the adhesive-backed straw holder could be applied to a plastic wrapper for a bottle or a blister pack for bottles and thereby serve as a label.

The straw holder according to the invention can also be incorporated in a cardboard package provided with perforations so that the straw holder can be torn out of the package and manipulated to separate the turns. In any event the straw holder can be provided with printed matter to serve as advertising. The tail end of the outer turn can be provided with a notch for fitting onto the beginning of the turn for better retention.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A straw holder for supporting a drinking straw in a mouth of a bottle, said holder being made from a sheet material and comprising:

a straw support portion dimensioned for placement across a mouth of a bottle and comprising an aperture formed by at least one slit in said sheet material designed to receive a straw therethrough and to vertically support said straw with respect to said support portion; and a bottle retaining portion comprising at least one turn extending around said retaining portion, said at least one turn comprising a first turn having an end attached to said straw support portion, and dimensioned to extend around an outer surface of the bottle, wherein said at least one turn extends spirally around said straw support portion, said at least one turn having an inner edge with an inner radius and an outer edge with an outer radius wherein said inner and outer radii increase substantially continuously around said at least one turn.

2. The straw holder as in claim 1, wherein said bottle retaining portion comprises a plurality of turns including a second turn attached to said first turn.

3. The straw holder as in claim 1, wherein said bottle retaining portion comprises a plurality of turns including at least one successive turn following said first turn to form a continuous spiral, the inner radius of said at least one successive turn corresponding to the outer radius of a preceding turn.

4. A straw holder for supporting a drinking straw in a mouth of a bottle, said holder comprising:

a straw support portion dimensioned for placement across a mouth of a bottle and comprising an aperture designed to receive a straw therethrough and to vertically support said straw with respect to said support portion; and a bottle retaining portion comprising at least one turn extending around said retaining portion, said at least one turn comprising a first turn having an end attached to said straw support portion, and dimensioned to extend around an outer surface of the bottle, wherein said at least one turn extends circularly about said straw support portion from said first end to a second end, said at least one turn having an inner edge with an inner radius and an outer edge with an outer radius wherein said inner and outer radii are substantially constant around said at least one turn, said retaining portion further comprising a radial connecting portion connected to said inner edge at said first end of said first turn and to a radially outer edge of straw support portion and connecting said first end of said first turn to said straw support portion.

5. The straw holder as in claim 4, wherein said at least one turn comprises a plurality of turns including at least one successive turn following said first turn, said retaining portion further comprising a radial connecting portion connecting the first end of said at least one successive turn to the second end of a preceding turn.

6. The straw holder as in claim 5, wherein the inner radius of each successive turn corresponds to the outer radius of a preceding turn.

7. The straw holder as in claim 4, wherein said straw retaining portion is substantially disk shaped and has a radius, said inner radius of said first turn corresponding to said radius of said disk.

8. The straw holder as in claim 1, wherein said sheet material is made of one of paper, plastic and cardboard having one of cuts and slits in said sheet material defining said straw support portion and said bottle retaining portion.

9. A straw holder for supporting a drinking straw in a mouth of a bottle, said holder being made from a sheet material and comprising:

a straw support portion dimensioned for placement across a mouth of a bottle and comprising an aperture formed by at least one slit in said sheet material designed to receive a straw therethrough and to vertically support said straw with respect to said support portion; and a bottle retaining portion comprising at least one turn extending around said retaining portion, said at least one turn comprising a first turn having an end attached to said straw support portion, and dimensioned to extend around an outer surface of the bottle, wherein said straw support portion and said bottle retaining portion are integrally formed of said sheet material and said straw holder has a central axis perpendicular to said sheet and passing through said aperture, said straw holder exhibiting both axial and radial elasticity relative to said axis, said axial elasticity being substantially greater than said radial elasticity.

10. The straw holder as in claim 1, wherein said straw support portion comprises an adhesive disposed about said aperture for engaging the drinking straw when disposed in said aperture.

11. The straw holder as in claim 1, wherein said aperture is dimensioned to receive a straw in an interference fit.

12. A straw holder for supporting a drinking straw in a mouth of a bottle, said holder being made from a sheet material and comprising:

a straw support portion dimensioned for placement across a mouth of a bottle and comprising an aperture formed by at least one slit in said sheet material designed to receive a straw therethrough and to vertically support said straw with respect to said support portion;

a bottle retaining portion comprising at least one turn extending around said retaining portion, said at least one turn comprising a first turn having an end attached to said straw support portion, and dimensioned to extend around an outer surface of the bottle; and adhesive disposed on one side of the straw support portion that contacts the mouth of the bottle.

13. The straw holder as in claim 1, wherein the straw support portion covers the entire mouth of the bottle.

14. The straw holder as in claim 1, wherein the at least one turn is dimensioned to engage the outer surface so that the straw holder is prevented from vertically lifting off of the mouth of the bottle.

15. The straw holder as in claim 12, wherein said at least one turn extends spirally around said straw support portion, said at least one turn having an inner edge with an inner radius and an outer edge with an outer radius wherein said inner and outer radii increase substantially continuously around said at least one turn.

16. The straw holder as in claim 12, wherein said at least one turn extends circularly about said straw support portion from said first end to a second end, said at least one turn having an inner edge with an inner radius and an outer edge with an outer radius wherein said inner and outer radii are substantially constant around said at least one turn, said retaining portion further comprising a radial connecting portion connecting said first end of said first turn to said straw support portion.

17. The straw holder as in claim 12, wherein said sheet material is made of one of paper, plastic and cardboard having at least one of cuts and slits in said sheet material defining the straw support portion and the bottle retaining portion.

18. The straw holder as in claim 17, wherein said straw support portion covers the entire mouth of the bottle.

19. The straw holder as in claim 9, wherein said sheet material is made of one of paper, plastic and cardboard having at least one of cuts and slits in said sheet material defining the straw support portion and the bottle retaining portion.

* * * * *